310-322 SR
4/3/84 XR 4,440,983

United States Patent [19]

Facoetti et al.

[11] 4,440,983

[45] Apr. 3, 1984

[54] ELECTRO-ACOUSTIC TRANSDUCER WITH ACTIVE DOME

[75] Inventors: Hugues Facoetti; Philippe Menoret; Francois Micheron; Patrick Petit; Pierre Ravinet, all of Paris, France

[73] Assignee: Thomson-CSF, Paris, France

[21] Appl. No.: 222,673

[22] Filed: Jan. 5, 1981

[30] Foreign Application Priority Data

Jan. 8, 1980 [FR] France ..... 80 00311

[51] Int. Cl.[3] ..... H04R 15/00

[52] U.S. Cl. ..... 179/110 A; 179/179; 181/151; 181/170; 310/322; 310/324; 310/326; 310/366; 310/800

[58] Field of Search ..... 179/110 A, 179; 310/322, 326, 366, 800, 324; 181/172, 157, 158, 170, 151

[56] References Cited

U.S. PATENT DOCUMENTS

| | | | |
|---|---|---|---|
| 3,424,873 | 1/1969 | Walsh | 181/172 X |
| 3,496,307 | 2/1970 | Sotome | 179/115.5 R |
| 4,045,695 | 8/1977 | Itagaki et al. | 310/322 |
| 4,284,921 | 8/1981 | Lemonon et al. | 310/328 |

*Primary Examiner*—Benjamin R. Fuller
*Attorney, Agent, or Firm*—Cushman, Darby & Cushman

[57] ABSTRACT

The invention relates to an electro-acoustic transducer using a self-supporting active radiating membrane made from a polymer material. The invention provides a transducer in which a resilient shape restoring member fixed to the case capped by the radiating membrane takes on the shape of the concave parts of the membrane, so as to oppose the definitive staving-in of the membrane by an accidental thrust force acting on the dome shaped protuberance on its outer face and restore the member to its initial shape when the force is removed.

9 Claims, 8 Drawing Figures

ELECTRO-ACOUSTIC TRANSDUCER WITH ACTIVE DOME

BACKGROUND OF THE INVENTION

The present invention relates to emitters and receivers of acoustic waves in which a transducer element of nondevelopable form serves for converting an electric AC voltage into vibrations or vice versa. It concerns more particularly loudspeakers and microphones in which the dome-shaped membrane is formed by a self-supporting structure made from a polymer material. The concave and convex faces of this structure are covered with capacitor-forming electrodes. The transducer effect used in these structures appears over the whole extent of the electrosensitive zones situated between the electrodes, which allows entirely active domes to be formed. The polymer materials used for manufacturing the active domes are in the form of homogeneous or dimorphous films whose thicknesses are generally between some tens and some hundreds of microns. In this case, the final shape may be obtained by thermoforming or electroforming. Self-supporting structures with very thin walls may also be obtained by molding or by coating.

Whatever the manufacturing technique used, the dome obtained has good mechanical strength because of the self-supporting properties which distinguish it from a flat film of comparable thickness. Nevertheless, by exerting a thrust in the center of the convex face of a dome, a mechanically stable stove-in portion may be created which completely changes the nature of the electro-acoustic properties. This buckling phenomenon is reversible, but to find again the initial shape it is necessary to exert a thrust in the opposite direction to that which caused the staving-in. In practice, the user does not have access to the convex face of a dome-shaped membrane, which involves delicate dismantling of the transducer when its membrane has been accidentally staved in. To palliate this disadvantage, the convex radiating face of an active dome may be protected by a grid, but this means is inoperative when the staving-in results from an overpressure. Furthermore, staving-in may sometimes cause breaks such that the dome cannot assume again completely its original shape. In addition to accidental staving-in which may occur during use of an active-dome electro-acoustic transducer, it should be pointed out that parasitic vibratory modes may appear and give rise to irregular deformations by stationary waves. Furthermore, the vibration of an active dome tends to be amplified by resonance in a narrow range of the acoustic spectrum, which is prejudicial to a good sound reproduction. The control of the frequency response characteristic of a polymer active dome is based on damping of its natural resonance and of those which may be caused to act by acoustic coupling. However, the modest efficiency of piezoelectric polymer transducers does not allow a purely electric damping of the resonances to be contemplated which is both simple to put into practice and sufficiently efficient.

SUMMARY OF THE INVENTION

In order to palliate the disadvantages mentioned above, the present invention proposes associating with an active self-supporting structure made from a polymer material a resilient shape restoring member acoustically permeable and corresponding in shape to the form of its concave face. The pressure exerted by this member prevents the dome from being staved in and participates in the mechano-acoustical damping thereof.

The invention provides an electro-acoustic transducer comprising a rigid case capped by a self-supporting radiating active membrane made from a polymer material having at least a domed shaped protuberance, wherein the case contains a resilient shape restoring member acoustically permeable and corresponding in shape to the form of the concave parts of the internal face of the radiating membrane; the shape taken by the bearing face of the shape restoring member being determined by the very shape of the radiating membrane.

DESCRIPTION OF THE DRAWINGS

The invention will be better understood from the following description and accompanying figures in which.

DESCRIPTION OF THE PREFERRED EMBODIMENT

Figure 1:
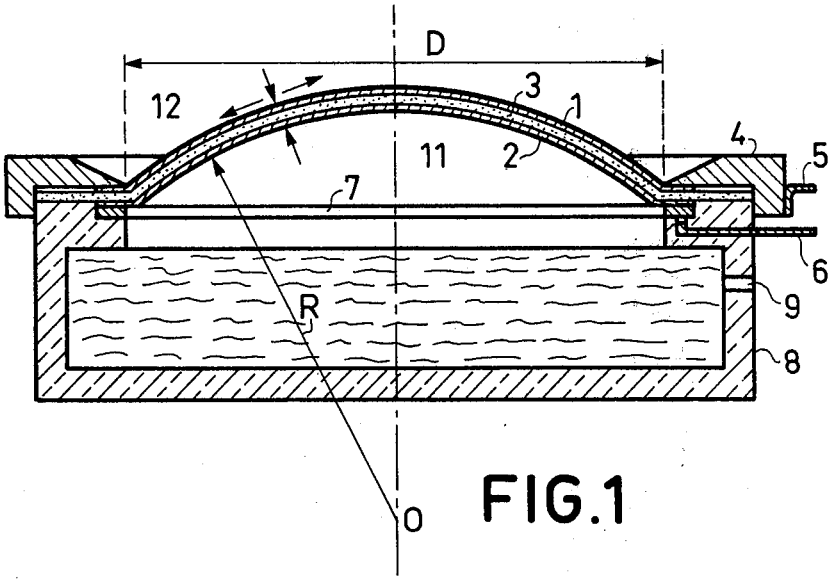
FIG. 1 is a sectional view of an electro-acoustic transducer comprising a piezoelectric polymer membrane.

In FIG. 1 there can be seen an electro-acoustic transducer capable of operating as a loundspeaker, as an earphone or as a microphone. It comprises a self-supporting active membrane obtained by thermoforming, electroforming, molding or coating with a film 3 of a piezoelectric polymer material. Film 3 is coated on both its faces with conducting deposits 1 and 2 forming capacitor electrodes. Membrane assembly 1, 2, 3 is in the form of a dome, for example a spherical calotte having center 0 and radius of curvature R. The membrane assembly is electrically equivalent to a capacitor and when an alternating electric voltage is applied between the electrodes, this active structure vibrates according to a mode of thickness accompanied by an alternate tangential extension mode. Membrane assembly 1, 2, 3 caps a rigid case 8 and it is fixed by its circumference to the flange of case 8 by means of a metal collar 4. A metal ring 7 placed in an annular housing in the flange of case 8 serves to establish electrical contact with electrode 2 which forms the concave face of the membrane. Ring 7 is electrically connected to a terminal 6. Collar 4 which clamps the circumference of the membrane also serves as a resilient connection for the electrode 1 which forms the convex face of the membrane. A terminal 5 is fixed to collar 4. The inside of case 8 communicates with the outside through an orifice 9 which serves for balancing the static pressures acting on each side of membrane assembly 1, 2, 3. The inner volume of the case is partially filled with an absorbent material 10 to prevent stationary waves from being established. Volume 11 in the immediate vicinity of electrode 2 is an air cushion at the static pressure of the environmental air 12 in which the acoustic waves emitted or received propagate. The frequency response characteristic of the electro-acoustic transducer depends on the diameter D of the vibrating piston formed by the radiating membrane assembly 1, 2, 3, on the compliance and inertance thereof, as well as on the acoustic impedance formed by case 8. The acoustic impedance of case 8 comes down to an acoustic capacity resulting from the enclosed volume of air and from the active surface of the vibrating piston; the absorbing material 10 increases this capacity and introduces a damping effect; the balancing hole 9 connects a series acoustic inertance in parallel with an acoustic resistance.

The membrane shown in FIG. 1 is formed from an homogeneous film of piezoelectric polymer material. The piezoelectric effect is of dipolar origin. The materials used for forming the membrane are polymers such as vinylidene polyfluoride $PVF_2$, once-substituted vinyl polyfluoride PVF and vinyl polychloride. Copolymers such as the copolymer of polyfluoride of vinylidene and of ethylene polytetrafluoride may also be used. The appearance of the piezoelectric properties is tied up with a previous treatment which comprises an intense electric polarization phase proceded or not by a mechanical stretching phase.

Figure 2:
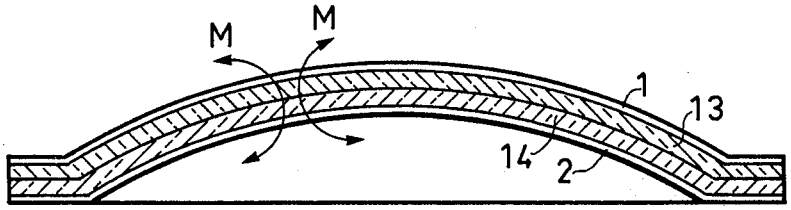
FIG. 2 is a sectional view of a dimorphous membrane.

Without departing from the scope of the invention, the membrane shown in FIG. 1 may be substituted by the one shown in section in FIG. 2.

The membrane of FIG. 2 is of the dimorphous type. It comprises two layers of polymer materials 13 and 14 which adhere perfectly to one another. Layers 13 and 14 may be made from dielectric materials devoid of piezoelectric properties. One at least of these layers has been subjected to a treatment for implanting electrical charges producing a permanent charge excess. When an alternating energizing voltage is applied to electrodes 1 and 2, the action of the electrostatic forces produces extensions which may be made different by an appropriate choice of the materials and of the charge excesses. With a differential extension proportional to the energizing electric fields, flexion torques M are obtained which cause alternate bending of the membrane. By way of nonlimiting example, a dimorphous membrane may be formed by using an electrically charged ethylene polytetrafluoride film which adheres perfectly to a vinyl polychloride film. Of course, the dimorphous structures may be formed wholly or partly from piezoelectric polymer materials.

Figure 3:
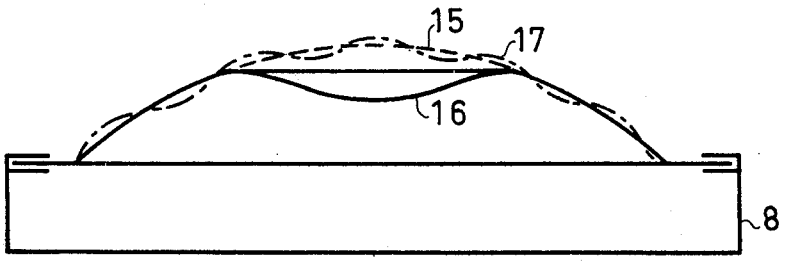
FIG. 3 illustrates the staving-in of a dome-shaped membrane and its parasite vibratory modes.

FIG. 3 shows schematically the essential part of the structures which have just been described. Case 8 which encloses a volume of air is capped by a self-supporting active membrane whose shape at rest is shown by the broken line 15. This membrane vibrates as a whole when it is subjected to electric or acoustic energization. However, because of its circumferential fixing, stationary-wave phenomena may give rise, at certain frequencies, to parasitic vibrations 17 (dot-dash line curve). Furthermore, the membrane may be staved in permanently as at 16 under the effect of an accidental thrust acting on the convex face. Since the membrane is fixed to case 8, it is not possible to smooth out this staved-in portion since, without delicate dismantling, access cannot be had to the concave fact. Such staving-in may result from clumsy handling by the use, but it may also result from an overpressure on the convex face of the membrane. However that may be, it must be considered that the self-supporting characteristic of the nondevelopable surfaces such as spherical calottes, truncated cone with straight or exponential profile, with concentric corrugations goes hand in hand with a substantial reduction of the thickness of the membranes (a few tens to a few hundred microns). The result is that these membranes are vulnerable to staving-in of their convex parts.

Figure 4:
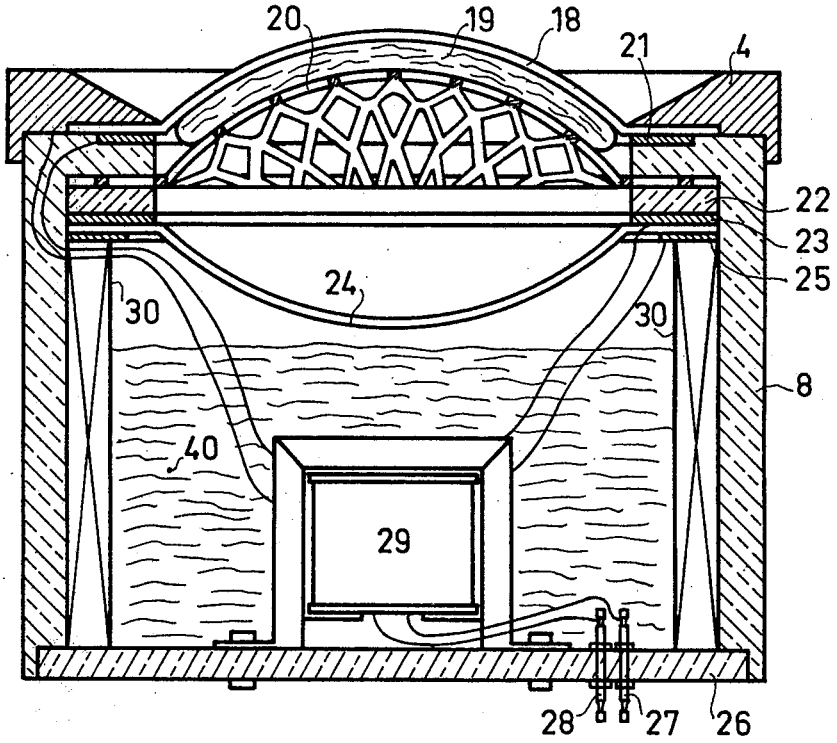
FIG. 4 is a sectional view of an electro-acoustic transducer in accordance with the invention.

In FIG. 4, a sectional view can be seen of an electro-acoustic transducer in accordance with the invention. It comprises a case 8 made from an insulating material having a bottom 26 equipped with connection terminals 27 and 28. A membrane 18 similar to those of FIGS. 1 and 2 cover a circular opening situated at the top of case 8. Membrane 18 rests on the flange of the circular opening of case 8 through an embedded metal ring 21. It is clamped by its flat annular circumference by means of a metal collar 4. Thus, the electrodes which cover the faces of membrane 18 are electrically connected to collar 4 and to ring 21 and these metal parts are in their turn connected to the output terminals of a voltage booster transformer 29. The input terminals of transformer 29 are connected to terminals 27 and 28 which pass through the bottom of case 28.

Figure 5:
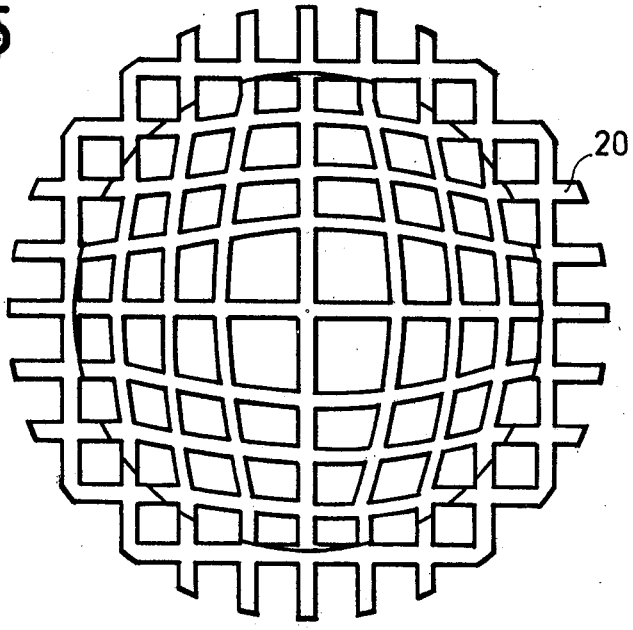
FIG. 5 is a top view of a thermosphaped grid.
Figure 7:
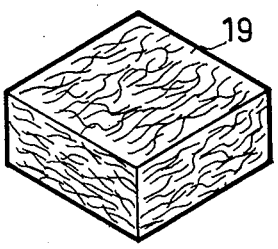
FIGS. 7 and 8 shows acoustically permeable compressible structures.
Figure 8:
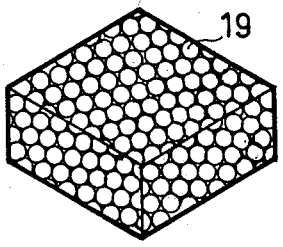

In accordance with the invention, case 8 contains immediately below membrane 18 an acoustically permeable resilient restoring member. This resilient member comprises at least two elements which are cushion 19 and grid 20, but these elements which are lightly pressed against the internal face of of membrane 18 are not supporting elements. In fact, membrane 18 is self-supporting and it imposes its shape on cushion 19 through the bulging shape of grid 20. A top view of grid 20 is given in FIG. 5. The texture of the materials used for forming cushion 19 is illustrated by FIGS. 7 and 8. As shown in FIG. 7, a low-density felt pad may be used whose compression has been stabilized by means of a bonding agent, but which maintains high porosity and good acoustic permeability.

By way of example, the glass wools used in the field of thermal or acoustic insulation may be mentioned. FIG. 8 shows a pad made from a cellular material having communicating cells; because of the low density the open cellular construction is reduced to its most simple expression, i.e. a three-dimensional mesh network. Different polymer foams such as polyurethane and polyester foams may also be mentioned. Since cushion 19 is slightly compressed between membrane 18 and grid 20, it is the bulging shape given to this latter which determines with the concave shape of membrane 18 the thickness of cushion 20. This thickness may vary from the center to the periphery of the membrane, or on the contrary may be uniform if the center of curvature of membrane 18 coincides with that of grid 20. Grid 20 is fixed inside the case against the flange which defines the circular opening capped by the membrane. A washer 22 held in place by a brace 30 which bears against the bottom of case 26 ensures clamping of the periphery of grid 20. Because of the acoustic permeability of the shape restoring member for membrane 18, another active self-supporting membrane such as 24 may be mounted inside the case. This internal membrane 24 is clamped between two contacting rings 23 and 25 which are inserted between washer 22 and brace 30. Rings 23 and 25 are also connected to the transformer 29, so that the two membranes may cooperate in sound radiation. The inside of case 8 may be lined with an absorbing material 40 to increase the acoustic capacity thereof and to combat stationary waves. The mechanical compliance of grid 20 and its mass may be chosen so as to form a mechanical resonator coupled to membrane 18 by means of cushion 19.

By way of nonlimiting example, grid 20 may be formed from a trelliswork of vinyl polychloride having a thickness of 2 mm and mesh in the form of diamonds whose diagonals measure 6 mm and 4.5 mm. Cushion 19 is then formed from two superimposed disks cut out from a polyester wool pad having a loadless thickness of 3 mm. For a membrane 18 having a piston diameter D of 7 cm, one of the disks has a diameter of 7 cm and the other a diameter of 4 cm. The distance between membrane 18 and grid 20 is of the order of 3 mm which ensures compression of the superimposed disks.

Figure 6:
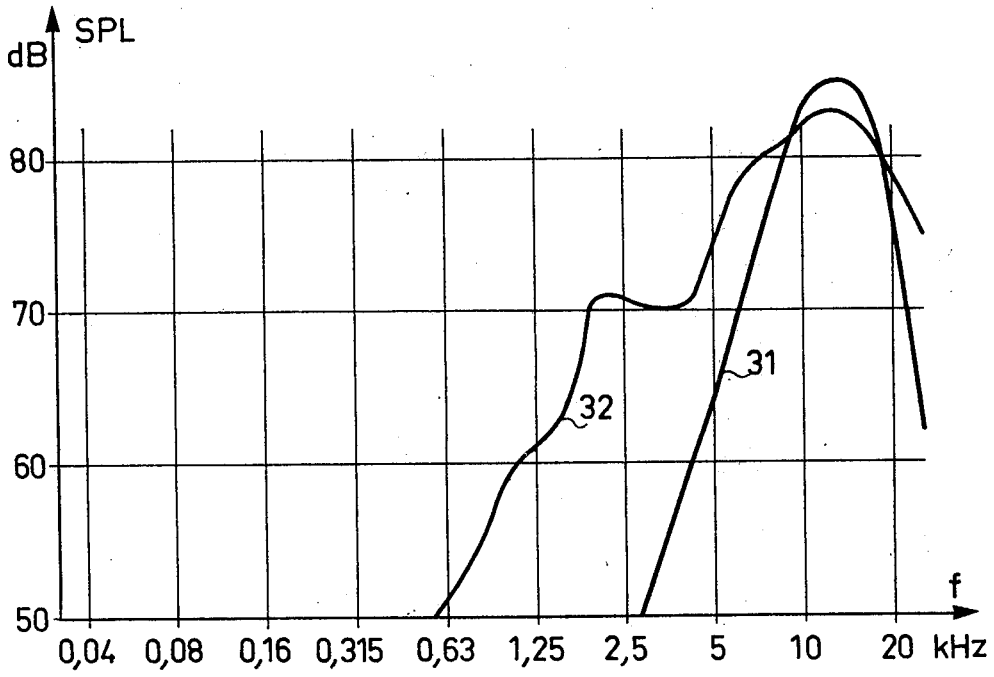
FIG. 6 indicates the frequency responses with or without a shape restoring member.

In FIG. 6, can be seen two frequency response curve readings corresponding to the transducer of FIG. 4 with the dimensions which have just been indicated. The sound pressure level SPL was measured with a microphone placed in the axis of the transducer at a distance of 30 cm from membrane 18. The electrical energizing power or white noise is adjusted to one true watt. Curve 31 gives the response of the transducer of FIG. 4 without cushion 19, grid 20 and without membrane 24. Curve 32 gives the response of the same transducer equipped this time with support 19, 20. It can be seen that the natural resonance of membrane 18 which extends between 10 and 18 kHz is flatter with cushion 19 which improves the response in this region of the acoustic spectrum. The response is also improved between 0.63 and 5 kHz, for the resonance of the membrane shape restoring member is used to accentuate its vibratory amplitude. The hollow which occurs in curve 32 between 2 kHz and 5 kHz may be filled up by introducing the natural radiation of membrane 24 which may be designed to radiate in this region of the spectrum.

Because of the presence of the membrane shape restoring member of the invention, it has been verified experimentally that the transducer has a great resistance to shocks, since membrane 18 recovers its shape after a fall on its convex face. Membrane 18 also resists well to the pressure of a finger. Insofar as the damping of the parasite vibrations of membrane 18 are concerned, cushion 19 introduces mechanical coupling which cooperates with the dissipative properties of the material forming this cushion.

The cushion also plays the role of coupling element between membrane 18 and the resonating structure formed by grid 20. It is thus possible to increase mechanically the radiation capability of the membrane in another region of the acoustic spectrum than that where its natural resonance is situated. The acoustic permeability of the cushion 19 and grid 20 assembly provides also acoustic coupling with the other passive or active impedances which are contained in case 8.

Although there has been described above and shown in the drawings the essential characteristics of the present invention applied to preferred embodiments thereof, it is evident that a man skilled in the art may make therein any modification to form or detail which he thinks useful, without departing from the scope of the invention.

In particular, the acoustic transparence may go hand in hand with air permeability of the cushion 19 and of grid 20, but it may also be suppressed when there is substituted therefor a self-supporting shell having good mechanical compliance and low mass and when a cellular foam with closed cells is used as cushion.

The two elements of the resilient shape restoring member may be merged into a single one, for example by treating with an appropriate bonding agent one of the faces of a fiber cushion for it to fulfil the function of a grid or of a thin bearing wall.

The proposed device extends of course to structures which provide static pressure of nonuniform value along the membrane. This effect may follow from the choice of an inhomogeneous loadless thickness of the damping cushion and/or from a shape of the grid such that the gap separating this latter from the membrane varies in thickness.

It is also possible to sandwich membrane 18 between two shape restoring members 19, 20, one of these members extending outwardly of case 8 of the electroacoustic transducer.

What is claimed is:

1. In an electro-acoustic transducer comprising a rigid case capped by a self-supporting active radiating membrane made from a polymer material having at least one dome shaped protuberance, said case being partially filled with an acoustically permeable resilient member having a bearing face conforming to the exact shape of the protuberance; the shape taken by the bearing face of said member being determined by the shape of said protuberance so that said resilient member is deformed by deformation of said protuberance in response to an applied force and restores said protuberance to its initial shape upon removal of said force.

2. The transducer as claimed in claim 1, wherein said resilient shape restoring member comprises a grid connected mechanically to said case and a compressible cushion clamped between the internal face of said membrane and said grid.

3. The transducer as claimed in claim 2, wherein said cushion is formed from a material composed of synthetic or mineral intertwined fibers.

4. The transducer as claimed in claim 2, wherein said cushion is formed from a cellular-type organic material.

5. The transducer as claimed in claim 5, wherein the cells forming said organic material are communicating.

6. The transducer as claimed in claim 1, wherein said case encloses at least one active radiating element coupled acoustically to the membrane capping said case.

7. The transducer as claimed in claim 1, wherein said radiating membrane takes on the shape of a dome having its convexity turned outwardly of said case.

8. The transducer as claimed in claim 1, comprising at least one radiating membrane made from piezoelectric polymer.

9. The transducer as claimed in claim 1, comprising at least one radiating membrane of the dimorphous type.

* * * * *